US006474936B1

(12) United States Patent
deBlanc et al.

(10) Patent No.: US 6,474,936 B1
(45) Date of Patent: Nov. 5, 2002

(54) BLOWER IMPELLER APPARATUS WITH ONE WAY VALVES

(75) Inventors: James J. deBlanc, Roseville, CA (US); David M. Dickey, Roseville, CA (US); Victoria Tsang Tam, Davis, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/834,768

(22) Filed: Apr. 13, 2001

(51) Int. Cl.[7] ..... F04D 27/00

(52) U.S. Cl. ..... 415/25; 415/46; 415/146; 415/125; 416/45

(58) Field of Search ..... 415/25, 36, 37, 415/46, 141, 146, 125; 416/44, 45, 51, 53, 178

(56) References Cited

U.S. PATENT DOCUMENTS

| | | | | | |
|---|---|---|---|---|---|
| 387,138 | A | * | 7/1888 | Bruce | 415/25 X |
| 1,600,522 | A | * | 9/1926 | Strehlke | 415/146 |
| 2,468,366 | A | * | 4/1949 | Habinski | 415/25 X |
| 2,738,124 | A | * | 3/1956 | Rosenbeg | 415/146 X |
| 2,950,686 | A | | 8/1960 | Ledel et al. | |
| 3,479,947 | A | * | 11/1969 | Myers | 415/146 |
| 3,856,432 | A | * | 12/1974 | Campagnuolo et al. | 416/45 |
| 3,901,623 | A | | 8/1975 | Grennan | |
| 4,303,375 | A | | 12/1981 | Foglesong et al. | |
| 4,540,337 | A | * | 9/1985 | Olsen | 415/25 X |
| 4,662,819 | A | | 5/1987 | Lakowske et al. | |
| 4,900,227 | A | * | 2/1990 | Trouplin | 416/186 A X |
| 5,620,306 | A | | 4/1997 | Day | |
| 6,276,895 | B1 | * | 8/2001 | Milana | 415/125 |
| 6,386,826 | B1 | * | 5/2002 | Jacob | 415/125 |

FOREIGN PATENT DOCUMENTS

| | | | | |
|---|---|---|---|---|
| DE | 280189 | * | 5/1913 | 416/45 |
| FR | 2254232 A | | 8/1975 | |

* cited by examiner

*Primary Examiner*—John E. Ryznic

(57) ABSTRACT

Blower designs for vented enclosures include an impeller having a plurality of blades. A plurality of one way valves are interleaved between the blades to permit substantial airflow only in one direction. One valve design incorporates flaps coupled to either the blades or the impeller body with spring loaded hinges. Another valve design incorporates a flexible flaps coupled to either the blades or the impeller body. In one embodiment, the one-way valves reside on an insertable hub disposed within an inner periphery of the impeller such that the valves and blades are interleaved. The valves close to restrict air flow when the impeller rotational speed is below a threshold range. The valves open to permit air flow when the rotational speed exceeds the threshold range.

21 Claims, 7 Drawing Sheets

BLOWER IMPELLER APPARATUS WITH ONE WAY VALVES

FIELD OF THE INVENTION

This invention relates to the field of blowers. In particular, this invention is drawn to blower impeller designs.

BACKGROUND OF THE INVENTION

Cabinetry or enclosures for heat generating equipment may contain one or more blowers for active or forced air cooling. The blower displaces the air within the enclosure volume with cooler air external to the enclosure volume. The blower acts as a pump to transfer air between the two environments. Depending upon the configuration, either the air within the enclosure or the air external to the enclosure is the source for the pump. Air pumped from the interior by the blower is replaced with air external to the enclosure through the vents. Alternatively, air pumped from the exterior of the enclosure into the enclosure displaces the air in the enclosure through the vents. Without active cooling, the components within the cabinetry can overheat resulting in erratic, unpredictable behavior or a shortened lifespan among other maladies.

Blower systems may incorporate multiple blowers for redundancy or to achieve a specific air flow pattern in order to ensure adequate cooling. The failure of a single blower, however, creates a new source for air. Moreover, the blower interface between the internal/external environments tends to be more efficient for transferring air than the enclosure vents. The blower interface thus tends to become a preferential source relative to the vents for the transfer of air. As a result, the air flow patterns within the enclosure may be sufficiently disrupted to prevent adequate cooling or to significantly decrease the efficiency of redundant blower systems.

One approach uses baffles to prevent reverse airflow. These baffles have a number of members that pivot to enable opening and closing the baffle. When the blower is off, gravity or other forces close the baffle. During normal operation, simple baffles rely upon the pressure developed by the blower to open. One disadvantage of simple baffles for equipment enclosures is the additional assembly steps required to mount the baffles on the equipment. Another disadvantage of simple baffles is that the baffles members significantly impeded the flow of air from the blower exhaust.

SUMMARY OF THE INVENTION

In view of limitations of known systems and methods, blower designs for vented enclosures are described. One blower design incorporates an impeller having a plurality of blades. A plurality of one way valves are interleaved between the blades to permit substantial airflow only in one direction.

In one embodiment, each blade is coupled to one of an impeller body or a corresponding blade with a spring loaded hinge. When the impeller has a rotational speed below a threshold range the flaps remain in a closed position substantially restricting air flow between the blades. The flaps open to permit air flow between the blades when the rotational speed exceeds the threshold range.

In an alternative embodiment, the impeller comprises a plurality of blades and a plurality of flexible flaps interleaved between the blades. Each flap is coupled to one of an impeller body or a corresponding blade. When the impeller has a rotational speed below a threshold range the flaps remain in a closed position substantially restricting air flow between the blades. The flaps flex open to permit air flow between the blades when the rotational speed exceeds the threshold range.

In another embodiment, an impeller includes a plurality of blades and a hub insert having a plurality of valves. The hub is disposed within an inner periphery of the impeller such that the valves and blades are interleaved. The valves remain in a closed position substantially restricting air flow between the blades when the impeller has a rotational speed below a threshold range. The valves open to permit air flow between the blades when the impeller speed exceeds the threshold range. In one embodiment, the hub further comprises a flexible strip with a plurality of flaps. A separation distance between the flaps is substantially equivalent to the distance between the leading edges of the blades.

In various embodiments, the impeller is configured for centrifugal pumping action. In various embodiments, the impeller blades form one of an airfoil, backward inclined, backward curved, radial, paddle and forward curved configuration.

Other features and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

In a typical redundant blower system, the system must be designed to adequately accommodate both the loss of pumping ability and the reduction in efficiency due to changed air flow patterns. In a system having multiple blowers specifically to achieve a particular air flow pattern without regard to redundancy, the introduction of a new source (or sink) of air may disrupt the air flow patterns sufficiently to prevent adequate cooling.

Blowers are effectively air pumps formed by a motor having an impeller for a rotor. The impellers comprise a plurality of air moving surfaces such as blades. Blower impellers may be classified as axial flow, centrifugal (i.e., radial) flow, or mixed flow with respect to how the air is moved relative to the axis of rotation of the impeller. The motor and blade designs are driven by the efficiency and power requirements of the application.

Figure 1:
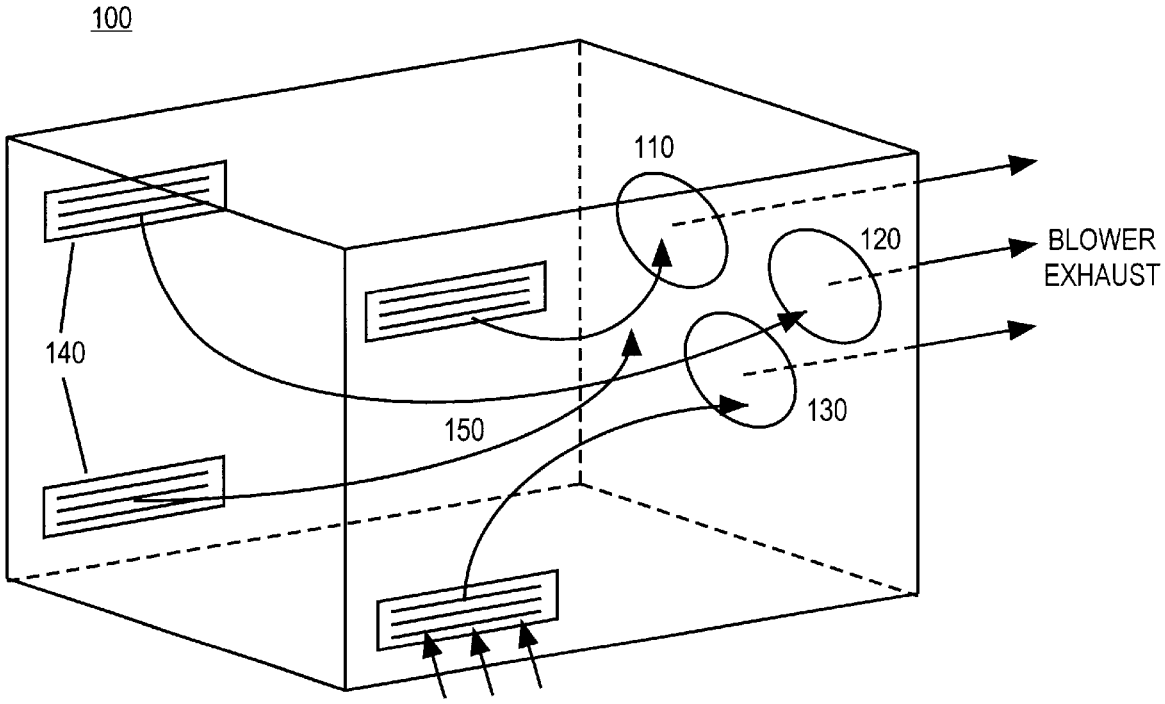
FIG. 1 illustrates one embodiment of air flow patterns in an enclosure utilizing a plurality of blowers for forced air cooling.

FIG. 1 illustrates one embodiment of an equipment enclosure 100 having a plurality of blowers 110, 120, 130 and vents 140. In this embodiment, air flow pattern indicators 150 show that forced air cooling is achieved when air external to the enclosure passes through vents 140 when replacing the air being pumped out of the enclosure by the blowers.

Figure 2:
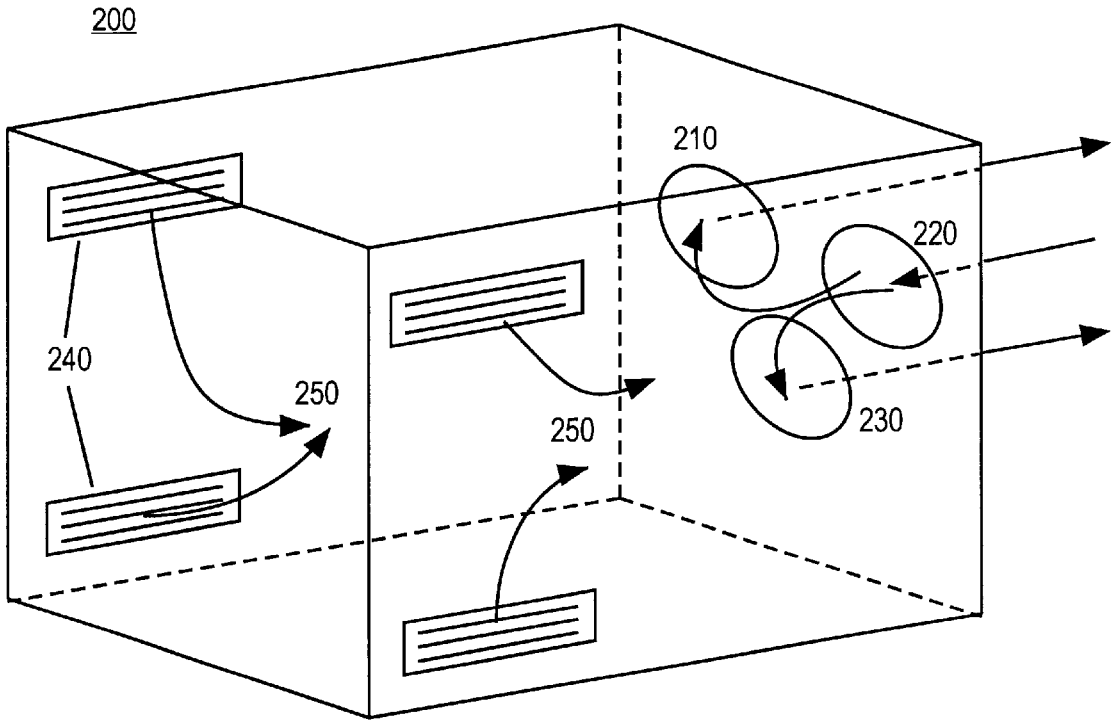
FIG. 2 illustrates one embodiment of air flow patterns in an enclosure having a plurality of blowers including at least one failed blower.

The number and placement of the blowers may have been chosen for the purpose of redundancy or to achieve a specific air flow pattern without regard to the possibility of failure. FIG. 2 illustrates an enclosure 200 with operating blowers 210 and 230 and failed blower 220. The blowers reside at interfaces between the inside and the outside of the enclosure 200 and thus serve as unintended vents in the event of a blower failure. Moreover, these interfaces may serve as a preferential source for air compared to any other vents 240 in the event of failure. The exhaust port of failed blower 220 serves as a preferential air intake compared to vents 240 thus undesirably disrupting the air flow 250 through the enclosure 200.

Figure 3:
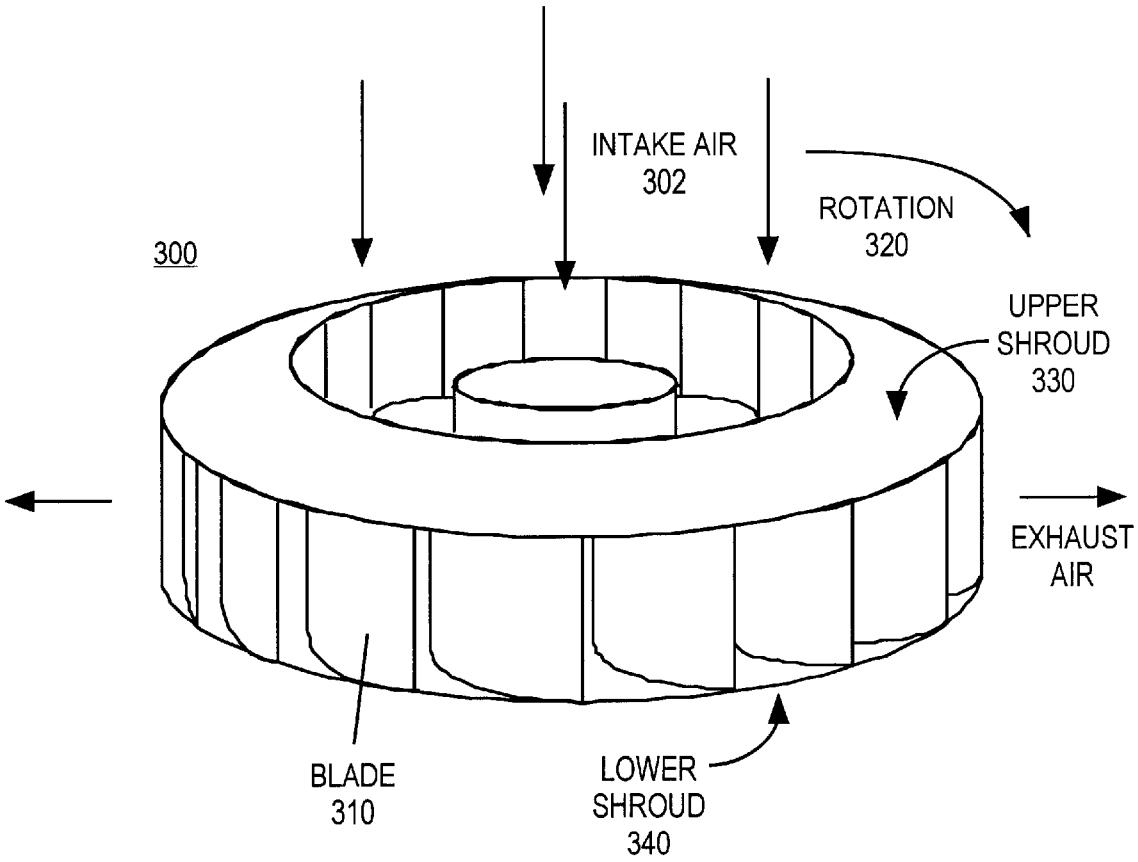
FIG. 3 illustrates one embodiment of an impeller.
Figure 4:
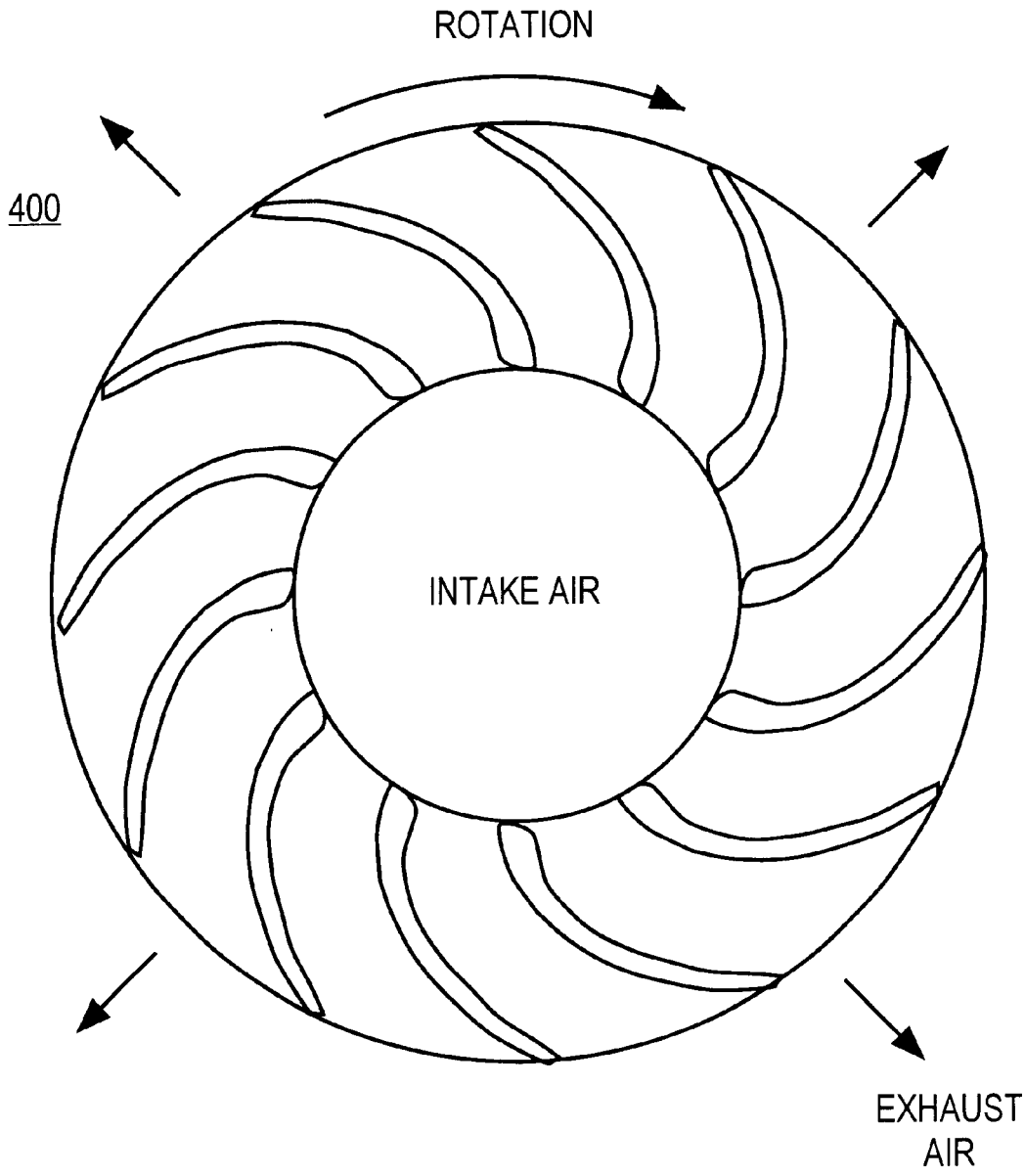
FIG. 4 illustrates a top view of an impeller blade configuration.

FIG. 3 illustrates one embodiment of a centrifugal blower impeller 300. Typical centrifugal impeller blade configurations include airfoil, backward inclined (illustrated), backward curved, radial, paddle, and forward curved. The blades may be attached to a common hub or shroud (e.g., 330, 340) of the impeller body. When impeller 300 rotates in a direction indicated by arc 320, air 302 is pulled into the center of the impeller from the source and then forced out between blades 310. The inefficiencies introduced by a failed blower may be significantly decreased through the use of an impeller designed to permit substantial air flow only during operation of the blower. FIG. 4 illustrates a top view of an impeller 400 without an upper shroud to illustrate the blade configuration. Impeller 400 has a backward inclined blade configuration.

Figure 5:
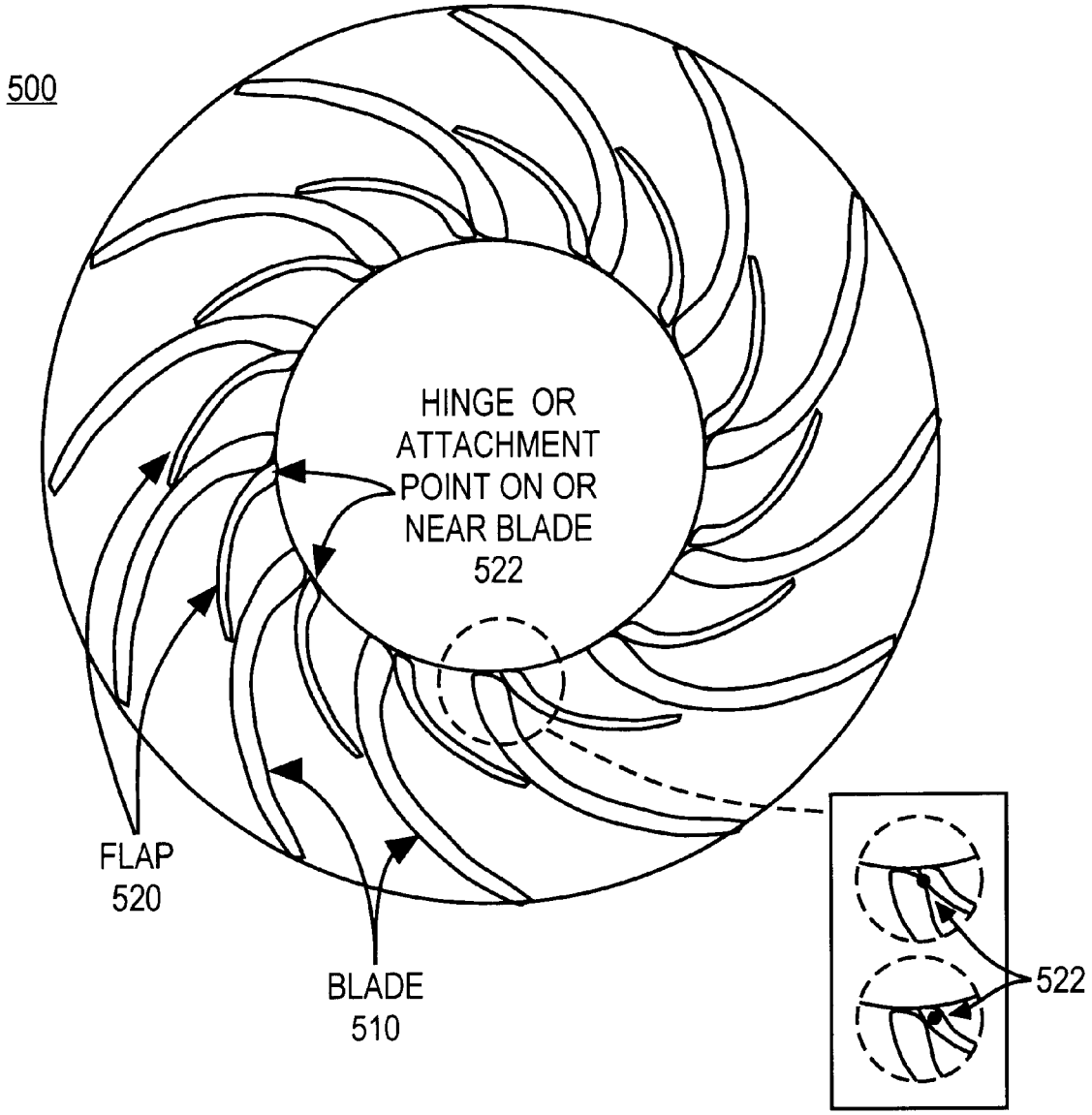
FIG. 5 illustrates one embodiment of a one-way blower impeller in a closed state.

FIG. 5 illustrates one embodiment of a centrifugal impeller 500 with modifications to substantially reduce undesirable air flow. Impeller 500 includes a set of fixed blades 510 and a set of valves or flaps 520 in a closed state. The blades and valves are interleaved. In one embodiment, each valve comprises a flap coupled to either the impeller body or a corresponding blade with a spring loaded hinge 522 at the leading edge of the blade. The hinge permits the flap to pivot about an axis substantially parallel to the impeller axis of rotation. The flaps are designed to substantially eliminate airflow between the blades when the impeller is stationary or rotating at a speed below a threshold range. The valves open when rotational or pressure forces overcome the holding power of the spring mechanism.

In an alternative embodiment, the flaps are designed with flexible materials such that no hinge is necessary. The flexible flap is attached to either the impeller body or a corresponding blade. The flaps open when the material deforms due to rotational or pressure forces. The resiliency of the material returns the flap to a closed state when the impeller rotational speed falls below a threshold range.

Figure 6:
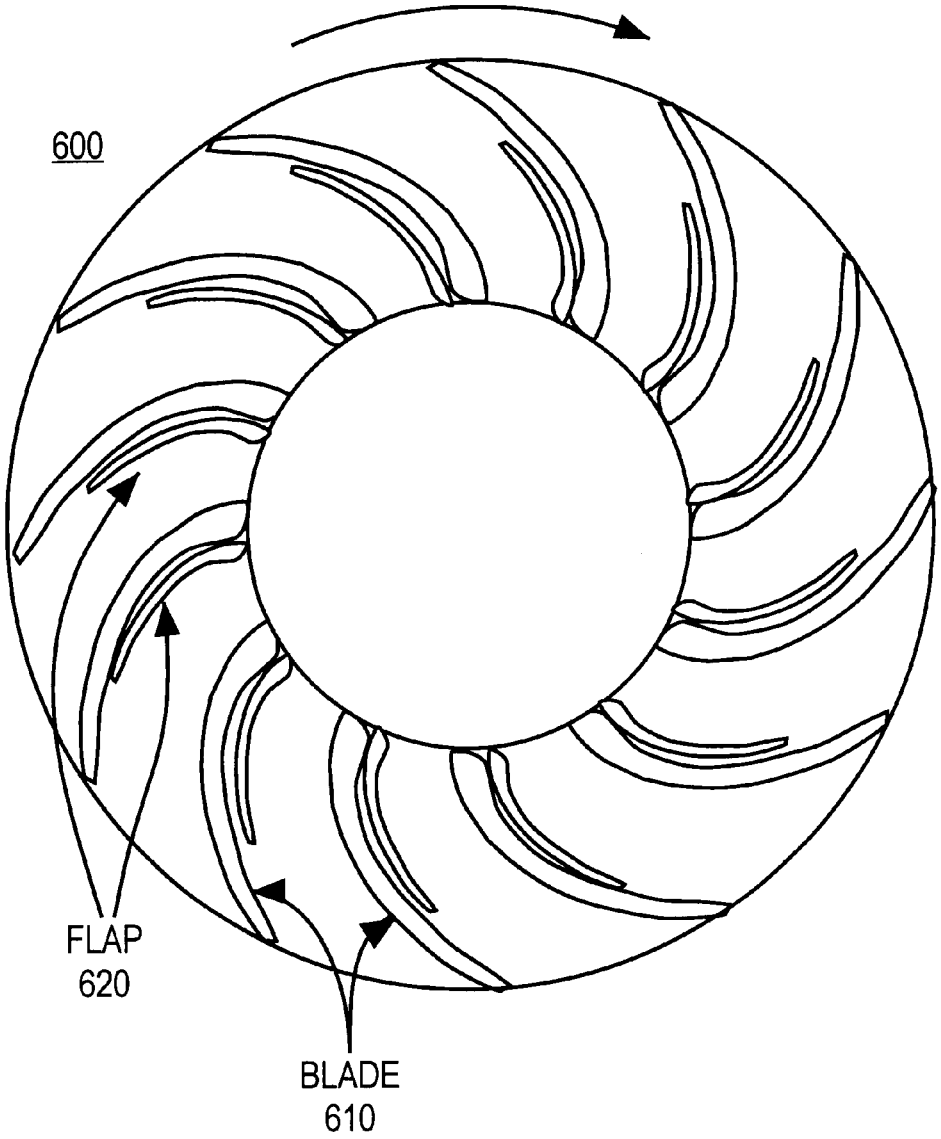
FIG. 6 illustrates one embodiment of a one-way blower impeller in an open state.

FIG. 6 illustrates the impeller of FIG. 5 when the flaps are in an open state. In one embodiment, the forces of rotation and from building pressure cause the flaps 620 to open and permit air flow between the blades 610 when the impeller 600 is rotating with sufficient velocity. The flaps return to the closed state of FIG. 5 when the impeller is rotating at a velocity below a threshold range. In the event flexible flaps are used, the material is of sufficient resiliency to return the flap to the closed state when the rotational speed falls below the threshold range.

Figure 7:
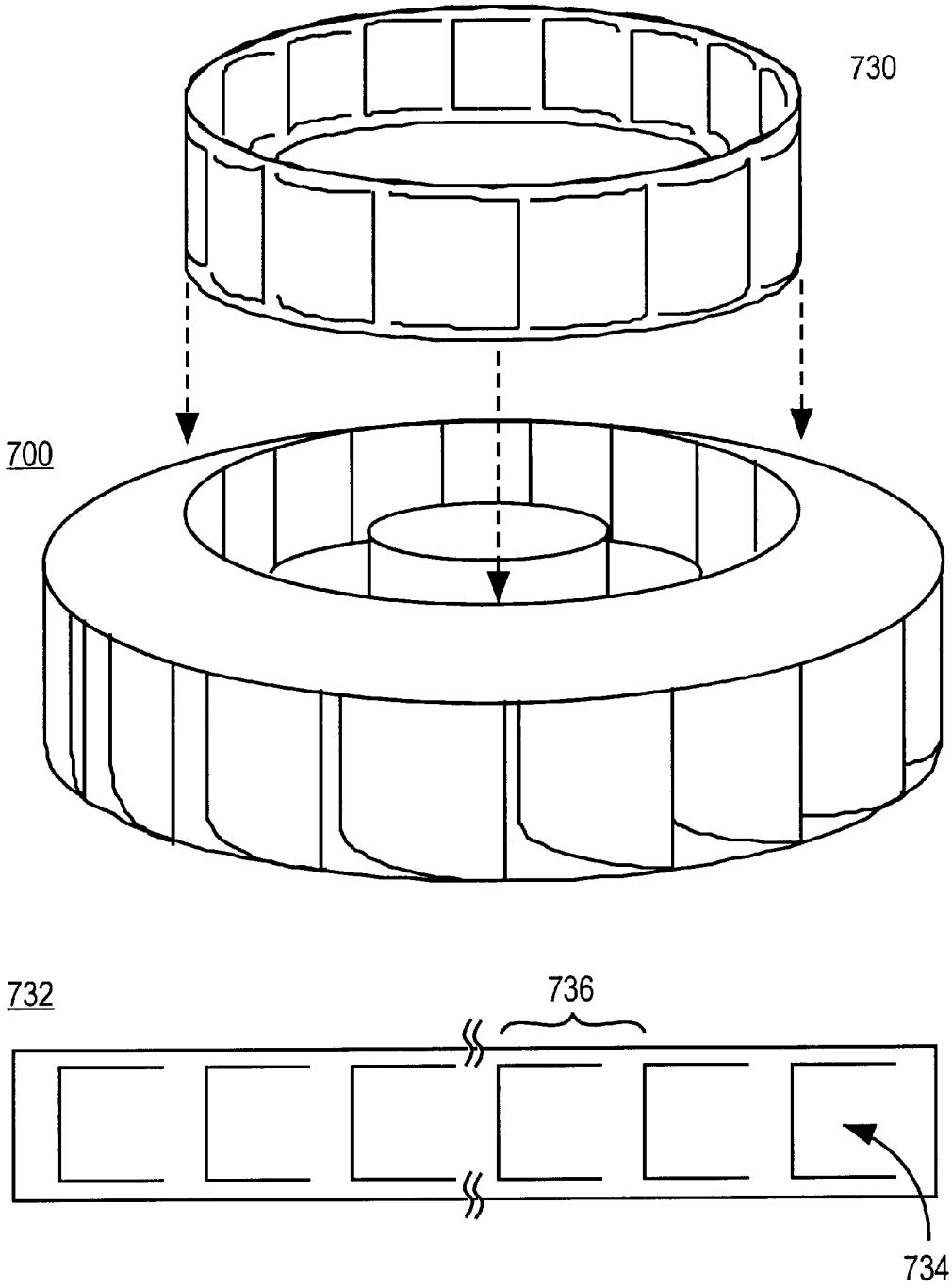
FIG. 7 illustrates one embodiment of an impeller with an insertable hub.

FIG. 7 illustrates an alternative embodiment of a centrifugal impeller 700. Hub 730 is inserted into the inner periphery of impeller 700. This embodiment may be desirable as a means of retrofitting pre-existing blower systems without replacing the blower assembly. In one embodiment, hub 730 comprises a plurality of hinged flaps. In an alternative embodiment, hub 730 comprises a strip of flexible material 732 comprising a plurality of die-cut doors or flaps 734. The separation distance 736 between doors is the same as the distance between the leading edges of the fixed impeller blades. The flaps serve as one way valves to permit air flow only when the impeller has a rotational speed above a threshold range.

The hub comprising the flexible strip is inserted into the inner periphery of the impeller 700. The strip is positioned so that the doors 734 are interleaved with the blades in the path of desired air flow. The doors 734 tend to remain closed due to the properties of flexible material 732 until forces due to rotational speed and building pressure force the doors open to permit air flow between the blades.

Applications of the one way impeller include blowers for enclosures designed for any heat generating equipment such as computers, computer peripherals, audiovisual equipment, electronic equipment racks, and generally any other powered equipment.

In the preceding detailed description, the invention is described with reference to specific exemplary embodiments thereof. Various modifications and changes may be made thereto without departing from the broader spirit and scope of the invention as set forth in the claims. The specification and drawings are, accordingly, to be regarded in an illustrative rather than a restrictive sense.

What is claimed is:

1. An impeller apparatus comprising:

a plurality of blades; and a plurality of one way valves interleaved between the blades, wherein the one way valves prevent substantial air flow in one direction.

2. The apparatus of claim 1 wherein the blades are coupled to an impeller body, wherein each valve comprises a flap coupled to the impeller body with a spring loaded hinge, wherein when the impeller has a rotational speed below a threshold range the spring loaded hinges maintain the flaps in a closed position substantially restricting air flow between the blades, wherein the flaps open to permit air flow between the blades when the impeller speed exceeds the threshold range.

3. The apparatus of claim 1 wherein each valve comprises a flap coupled to a corresponding blade with a spring loaded hinge, wherein when the impeller has a rotational speed below a threshold range the spring loaded hinges maintain the flaps in a closed position substantially restricting air flow between the blades, wherein the flaps open to permit air flow between the blades when the impeller speed exceeds the threshold range.

4. The apparatus of claim 1 wherein the blades are configured for centrifugal pumping action.

5. The apparatus of claim 3 wherein the blades form a selected one of an airfoil, backward inclined, backward curved, radial, paddle, and forward curved configuration.

6. An impeller apparatus comprising:

a plurality of blades; and a plurality of flexible flaps interleaved between the blades, wherein when the impeller has a rotational speed below a threshold range the flaps remain in a closed position substantially restricting air flow between the blades, wherein the flaps flex open to permit air flow between the blades when the rotational speed exceeds the threshold range.

7. The apparatus of claim 6 wherein each flap is coupled to a body of the impeller.

8. The apparatus of claim 6 wherein each flap is coupled to a corresponding blade.

9. The apparatus of claim 6 wherein the blades are configured for centrifugal pumping action.

10. The apparatus of claim 9 wherein the blades form a selected one of an airfoil, backward inclined, backward curved, radial, paddle, and forward curved configuration.

11. An apparatus comprising:

an impeller having a plurality of blades; and a hub comprising a plurality of valves, wherein the hub is disposed within an inner periphery such that the valves are interleaved between the blades, wherein the valves remain in a closed position substantially restricting air flow between the blades when the impeller has a rotational speed below a threshold range, wherein the valves open to permit air flow between the blades when the impeller speed exceeds the threshold range.

12. The impeller of claim 11 wherein the blades are configured for centrifugal pumping action.

13. The impeller of claim 11 wherein the blades form a selected one of an airfoil, backward inclined, backward curved, radial, paddle, and forward curved configuration.

14. The apparatus of claim 11 wherein the hub further comprises:

a flexible strip having a plurality of flaps, wherein a separation distance between flaps is substantially equivalent to a distance between leading edges of adjacent blades.

15. An apparatus comprising:

an enclosure having at least one vent; and a plurality of blowers for exchanging air between the interior and the exterior of the enclosure in co-operation with the vent, wherein each blower comprises an impeller having a plurality of blades and a plurality of one way valves, wherein the one way valves are interleaved with the blades to substantially restrict reverse air flow through the blower when the rotational speed of the impeller falls below a threshold range.

16. The apparatus of claim 15 wherein the plurality of blades of at least one impeller is configured for centrifugal pumping action.

17. The at least one impeller of claim 16 wherein the blades form a selected one of an airfoil, backward inclined, backward curved, radial, paddle, and forward curved configuration.

18. The apparatus of claim 15 wherein at least one impeller comprises:

a plurality of flaps interleaved between the blades to form the one way valves, wherein each flap is coupled to one of a corresponding blade and an impeller body with a spring loaded hinge, wherein when the impeller has a rotational speed below a threshold range the spring loaded hinges maintain the flaps in a closed position substantially restricting air flow between the blades, wherein the flaps open to permit air flow between the blades when the rotational speed exceeds the threshold range.

19. The apparatus of claim 15 wherein at least one impeller comprises:

a plurality of flexible flaps interleaved between the blades to form the one way valves, wherein each flap is coupled to one of a corresponding blade and an impeller body, wherein when the impeller has a rotational speed below a threshold range the flaps remain in a closed position substantially restricting air flow between the blades, wherein the flaps flex open to permit air flow between the blades when the rotational speed exceeds the threshold range.

20. The apparatus of claim 15 wherein at least one impeller further comprises:

a hub comprising the plurality of valves, wherein the hub is disposed within an inner periphery of the impeller such that the valves are interleaved between the blades, wherein the valves remain in a closed position substantially restricting air flow between the blades when the impeller has a rotational speed below a threshold range, wherein the valves open to permit air flow between the blades when the impeller speed exceeds the threshold range.

21. The apparatus of claim 20 wherein the hub further comprises:

a flexible strip having a plurality of flaps, wherein a separation distance between flaps is substantially equivalent to a distance between leading edges of adjacent blades.

* * * * *